US006666576B2

(12) United States Patent
Kaelin et al.

(10) Patent No.: US 6,666,576 B2
(45) Date of Patent: Dec. 23, 2003

(54) WATCH CASE ASSEMBLED VIA THE BEZEL

(75) Inventors: Laurent Kaelin, Sonvilier (CH); Chrystel Gressly, Delémont (CH)

(73) Assignee: Eta SA Fabriques d'Ebauches, Grenchen (FR)

( * ) Notice: Subject to any disclaimer, the term of this patent is extended or adjusted under 35 U.S.C. 154(b) by 176 days.

(21) Appl. No.: 10/060,176

(22) Filed: Feb. 1, 2002

(65) Prior Publication Data

US 2002/0131332 A1 Sep. 19, 2002

(30) Foreign Application Priority Data

Mar. 15, 2001 (CH) ..... 0481/01

(51) Int. Cl.[7] ..... G04B 37/00; G04B 29/00
(52) U.S. Cl. ..... 368/295; 368/300; 368/309
(58) Field of Search ..... 368/88, 276, 281, 368/294, 295, 299, 300, 309

(56) References Cited

U.S. PATENT DOCUMENTS 3,640,065 A * 2/1972 Lederrey et al.
3,672,155 A 6/1972 Bergey et al.
4,522,508 A * 6/1985 Meister ..... 368/276
4,831,607 A * 5/1989 Muller ..... 368/309
5,825,722 A 10/1998 Meyrat et al.

FOREIGN PATENT DOCUMENTS

| | | |
|---|---|---|
| CH | 294 402 A | 11/1953 |
| CH | 659560 | 2/1987 |
| CH | 681414 | 3/1993 |
| EP | 0 064 951 A | 11/1982 |
| FR | 2 741 964 A | 6/1997 |

* cited by examiner

*Primary Examiner*—Vit Miska
(74) *Attorney, Agent, or Firm*—Sughrue Mion, PLLC

(57) ABSTRACT

The watch case includes a back cover (2), a middle part (3) and a bezel (4) closed by a crystal (5) delimiting together a space in which a watch movement (1) is housed for an analogue or digital time display on a dial (6) arranged below the crystal (5). It is characterized in that the bezel (4) is made of metal and has locally a ring (14) of sufficient thickness to include in its lower portion a first series of threaded holes (11) for screwing in a first series of screws (10) for fixing the movement (1) onto the bezel (4) and a second series of threaded holes (21), offset angularly with respect to the first series, passing through the movement (1), and intended for screwing the back cover (2) into the lower part of the bezel (4).

12 Claims, 1 Drawing Sheet

WATCH CASE ASSEMBLED VIA THE BEZEL

The present invention concerns a watch case whose constituent elements are secured to each other via the bezel. The invention more particularly concerns a watch case able to classified in the "three part" category, i.e. a case including an independent bezel, middle part and back cover, which after assembly, delimit with the crystal a space in which a movement is housed allowing a digital or analogue time display on a dial arranged below the crystal.

In order to secure these three parts to each other, in very numerous devices already proposed, the middle part generally constitutes the essential element allowing the bezel and back cover to be secured by screws, being driven in, or by bonding.

It is for example possible to provide in the middle part, on one side a first series of holes for screwing in the bezel, and on the other side a second series of holes for screwing in the back cover, the movement or the casing ring containing the latter then being wedged on by suitable shoulders in the middle part.

In Swiss Patent No. 645 497, only a single series of holes is provided for accommodating a first screw used to secure the bezel and whose threaded head, embedded in the middle part allows a second screw to be screwed in to fix the back cover, the two screws having opposite pitch. This stacked assembly may lead one to believe that the bezel is the essential assembly element, but it is clear that the middle part is indispensable for closing the periphery of the case and for allowing a movement to be set in place.

The watch case disclosed in European Patent No. 0 443 366 is formed of two shells joined by a middle part, the lower shell forming a screwed on back cover and the upper shell in fact being a thin bonded crystal-bezel.

The watch case according to the present invention on the other hand allows an assembly to be obtained of the various constituent elements, without using the middle part as a mechanical connecting element. The middle part nonetheless keeps a functional role in particular for reinforcing sealing and for allowing the strands of a wristband to be secured. Since it has no mechanical function it can also be made more simply and economically, for example by moulding or plastic material injection moulding and thus allowing great freedom of choice as regards the different collection designs.

The invention thus concerns a watch case including a back cover, a middle part and a bezel closed by a crystal delimiting together a space in which a watch movement is housed supported by a plate and allowing an analogue or digital time display on a dial arranged below the crystal. The construction of this case is characterised in that the bezel forms the essential assembly element. In order to do this the bezel is made of metal and has locally a ring of sufficient thickness to allow series of blind holes to be made in its lower part. A first series of threaded holes is intended for screwing in a first series of screws for fixing the movement onto the bezel. A second series of threaded holes, offset angularly with respect to the first series, passing through the movement, is intended for screwing the back cover into the lower part of the bezel.

In order to have greater precision in positioning the movement, it is also possible also to provide in the bottom of the bezel two blind holes in which two pins, mounted on the movement, will engage.

The bezel, the movement and the back cover thus form a perfectly rigid unit which is not sensitive to shock waves capable of destabilising the fragile parts of the movement. It goes without saying that the assembly of these three elements is achieved by inserting the middle part which, since it no longer has an assembly function, can be loose between sealing gaskets provided in the region of the middle part and back cover and allow wristband strands to be secured.

In order to fix the movement and the back cover onto the bezel, facing the two series of threaded holes, holes are provided either in the plate supporting the elements of the movement, or in a casing ring of said plate.

Other features and advantages of the present invention will appear more clearly upon reading the following detailed description of an embodiment of an analogue display watch case, with reference to the annexed drawings, in which.

Figure 1:
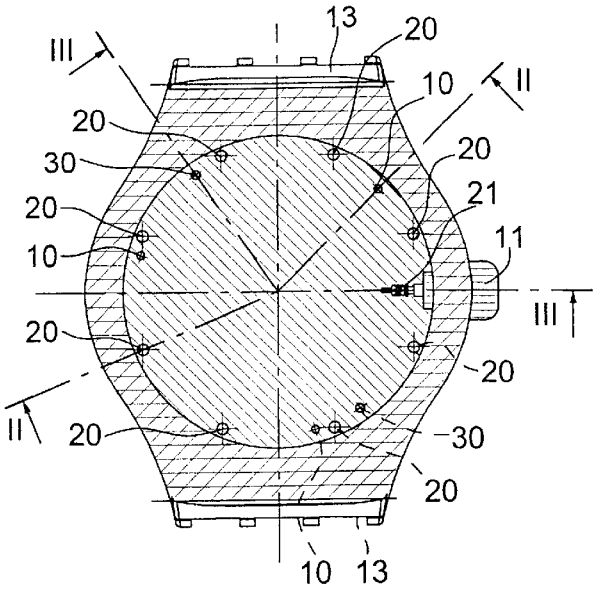
FIG. 1 is a bottom view of the watch case.
Figure 2:
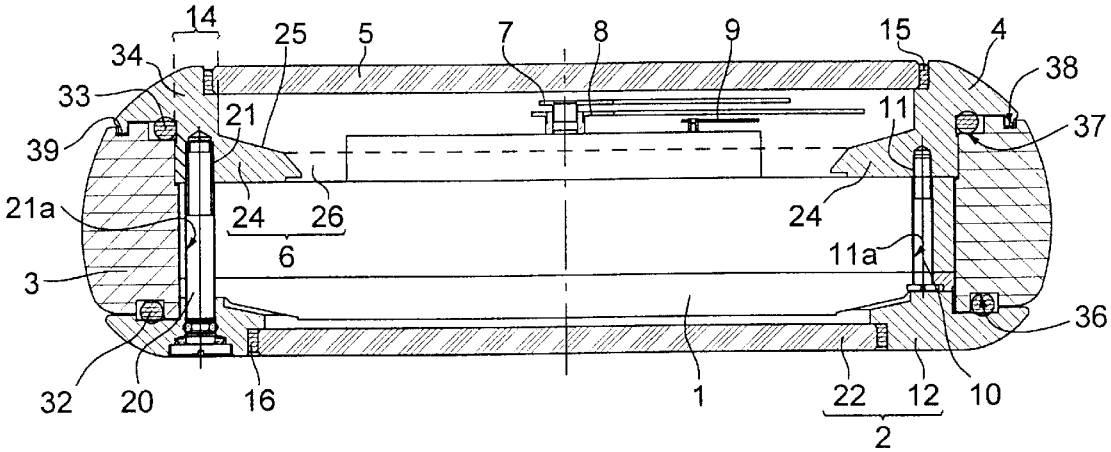
FIG. 2 is a broken cross-section along the line II—II of FIG. 1.

With reference first of all to FIGS. 1 and 2, a wristwatch can be seen with an analogue display by means of hour hand 7, minute hand 8 and a small seconds hand 9. In the bottom view shown in FIG. 1, it is assumed that the back cover was entirely transparent to show the angular distribution of fixing means 10, 20, 30 on bezel 4. In the example shown, the case is designed for a so-called "skeleton" watch, i.e. in which the wheel sets (not shown) of movement 1 are visible.

The case is formed of a back cover 2, a middle part 3 and a bezel 4 closed by a crystal 5 with the insertion of a sealing gasket 15. Back cover 2 may obviously be made in a single part, but in a "skeleton " model back cover 2 is preferably formed by an outer ring 12, said ring preferably being opaque in order to mask the fixing or sealing elements, and by a transparent disc 22 blocked in ring 12 by sealing gaskets 16. Transparent disc 22 has substantially the same diameter as crystal 5, or even slightly smaller, and can be made of the same material as crystal 5. Back cover 2, or back cover ring 12, may be made of any sufficiently rigid material, but it will preferably be made of metal to guarantee better cohesion of the assembled elements.

Figure 3:
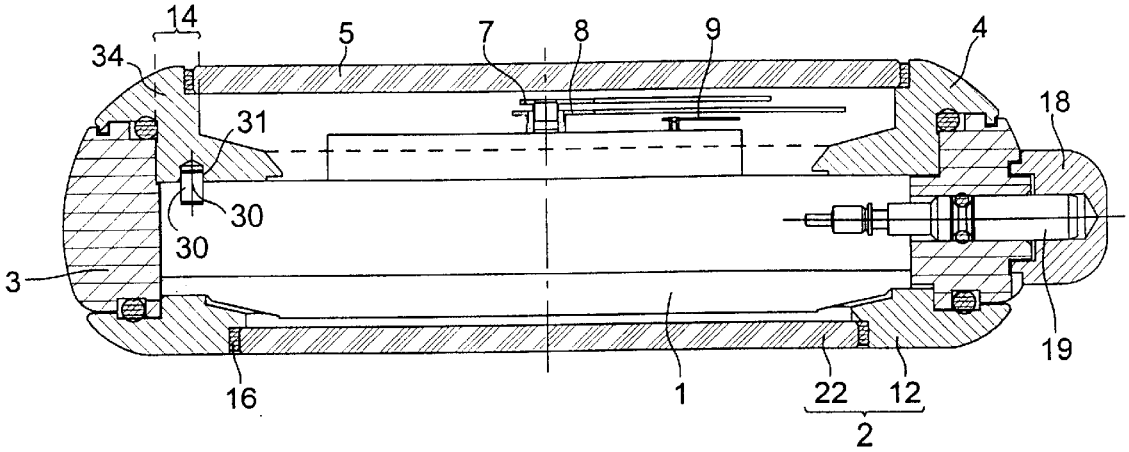
FIG. 3 is a broken cross-section along the line III—III of FIG. 1.

Bezel 4, according to a feature of the invention, is made of metal and has a ring of sufficiently thick material 14 to allow blind holes to be made in it, as shown in FIGS. 2 and 3. FIG. 2 shows a cross-section along the line II—II of FIG. 1, passing through the centre and through two types of securing elements. In the right part movement 1 is shown fixed to bezel 4 by means of a first series of screws 10 screwed into threaded holes 11 of bezel 4. In the example shown, as can be seen in FIG. 1, this fixing is achieved at three points regularly distributed around ring 14. The fixing is through holes 11*a* provided in the support of movement 1 which may be either the plate itself (not shown) supporting movement 1, or a casing ring (not shown) to which movement 1 is securely fixed. The plate or casing ring are blocked by screws 10 onto a ring of the lower face of bezel 4 preferably having beyond ring 14, an extension 24 in the direction of the centre of the watch, said extension 24 contributing to making bezel 4 rigid and thus guaranteeing the assembly precision of movement 1 on said bezel 4. In the example of the "skeleton " watch shown, extension 24 will advantageously be limited to a ring preferably having a surface 25 sloping towards the centre of the watch, which allows the time indications added to said surface 25 to be more legible, while leaving the movement, and in particular the gear trains, perfectly visible in a central opening 26. In the case of a "non-skeleton " watch, ring 24 may be extended as far as the hole of hands 7, 8 and thus form a bezel-dial.

Central opening 26 may also be sealed by an opaque disc independent of annular extension 24.

Again with reference to FIG. 3, it can be seen that the positioning of movement 1 on bezel 4 can be made more precise thanks to two pins 30 secured to movement 1 and which are engaged in blind holes 31 of bezel 4. Pins 30 are shown in a diametral position, but they could obviously have a different angular position, provided that they do not coincide with first series of screws 10.

A second series of screws 20 is used to fix back cover 2 by being screwed into threaded holes 21 of bezel 4. As can be seen in FIG. 3, by way of example, one may have eight fixing points which are evenly distributed and offset with first series of screws 10. Screws 20 pass through back cover 2 in its annular portion 12, then movement 1 through holes 21*a* provided in the plate or casing ring. Holes 21*a* are provided with a slight play so that screwing in screws 20 does not compromise the fit of movement 1 onto bezel 4.

The assembly which has just been described is achieved by inserting middle part 3 before mounting back cover 2. As the middle part is no longer involved in the positioning and mounting of movement 1 it may have a simple shape essentially including means 13 for securing wristband strands and means for reinforcing sealing. Thus, the lower portion of middle part 3 includes an annular groove 36 for accommodating a sealing gasket 32 abutting the upper surface of outer ring 12 of back cover 2. Likewise, the upper inner edge of the middle part includes an annular recess 37 for accommodating a sealing gasket 33 abutting the lower surface of extension 34 of bezel 4. This extension 34 also includes at its end an annular tip 39 which engages in a corresponding groove 37 of middle part 3. Although this cannot be shown in FIGS. 2 and 3, the total height of middle part 3 and the thickness of sealing gaskets 32 and 33 are preferably selected so that there remains a slight play between middle part 3 and back cover 2, on the one hand, and bezel 4 on the other hand.

Thus, in a way, middle part 3 is mounted so as to float between these two assembly elements of the case and can thus have a shock dampening function. It will also be observed that this construction allows quite broad manufacturing tolerances to be accepted, and allow it to be made for example by moulding or plastic material injection moulding whose colouring can be very easily modified for example for a given collection.

It will easily be understood that the example which has just been described is not limited to a wristwatch with an analogue time display, and that those skilled in the art can, without departing from the scope of the present invention, adapt the features of the case to any timepiece providing time-related or non-time-related information in an analogue or digital manner.

What is claimed is:

1. A watch case including a back cover, a middle part and a bezel closed by a crystal delimiting together a space in which a watch movement is housed supported by a plate and allowing an analogue or digital time display on a dial arranged below the crystal, wherein the bezel is made of metal and has locally a ring of sufficient thickness to include in its lower portion a first series of threaded holes for screwing in a first series of screws for fixing the movement onto the bezel and a second series of threaded holes, offset angularly with respect to the first series, passing through the movement, and intended for screwing the back cover into the lower part of the bezel.

2. A watch case according to claim 1, wherein the ring made as an over thickness in the bezel further includes two blind holes in which two pins are engaged prior to screwing in the screws, said pins being fixed to the movement to assure the relative positioning of the movement and the bezel.

3. A watch case according to claim 1, wherein the display is of the analogue type, and in that the bezel is extended under the crystal by a ring bearing the hour symbols.

4. A watch case according to claim 3, wherein the ring bearing the hour symbols is inclined towards the centre of the watch.

5. A watch case according to claim 1, wherein the bezel is extended under the entire surface of the crystal to form a dial.

6. A watch case according to claim 1, wherein the back cover is also made of metal.

7. A watch case according to claim 1, wherein the watch is of the skeleton type and in that the central part of the back cover is replaced by a transparent disk having substantially the same diameter as the crystal.

8. A watch case according to claim 1, wherein the movement is directly secured to the bezel by means of the plate supporting the components and/or the gear trains.

9. A watch case according to claim 1, wherein the movement is supported by a casing ring including holes for the passage of screws allowing it to be secured to the bezel.

10. A watch case according to claim 1, wherein the middle part is mounted so as to float between the bezel and the back cover by being clamped between two annular sealing gaskets housed in grooves respectively in the back cover and the bezel.

11. A watch case according to claim 1, wherein the middle part comprises means for securing wristband strands.

12. A watch case according to claim 1, wherein the middle part is made by moulding or plastic material injection moulding.

* * * * *